US006692387B2

(12) United States Patent
Berens et al.

(10) Patent No.: US 6,692,387 B2
(45) Date of Patent: Feb. 17, 2004

(54) RACQUET STRING ALIGNMENT TOOL

(76) Inventors: Randall S. Berens, 4419 Colfax Ave., Studio City, CA (US) 91602; Michael G. Sullivan, 1115 N. Old Mill Rd., Azusa, CA (US) 91702

( * ) Notice: Subject to any disclaimer, the term of this patent is extended or adjusted under 35 U.S.C. 154(b) by 0 days.

(21) Appl. No.: 10/143,045

(22) Filed: May 7, 2002

(65) Prior Publication Data

US 2002/0193190 A1 Dec. 19, 2002

Related U.S. Application Data

(60) Provisional application No. 60/291,491, filed on May 16, 2001.

(51) Int. Cl.[7] ..... A63B 49/00
(52) U.S. Cl. ..... 473/553
(58) Field of Search ..... 473/553, 524, 473/408; 224/666, 918; 206/315.1; 70/405; D8/347, 348

(56) References Cited

U.S. PATENT DOCUMENTS

| | | | | | |
|---|---|---|---|---|---|
| 2,593,042 | A | * | 4/1952 | Lynskey | 211/70.1 |
| 4,062,482 | A | * | 12/1977 | Szalony | 224/247 |
| 4,082,272 | A | | 4/1978 | Garver | |
| 4,089,523 | A | | 5/1978 | Newburger et al. | |
| 4,489,942 | A | | 12/1984 | Kent | |
| 4,733,866 | A | | 3/1988 | Herbert | |
| 4,736,877 | A | * | 4/1988 | Clark | 224/666 |
| 4,752,071 | A | | 6/1988 | Tabach | |
| 4,776,591 | A | | 10/1988 | Ho | |
| 4,852,782 | A | * | 8/1989 | Wu et al. | 224/661 |
| 4,989,864 | A | * | 2/1991 | Ubl | 473/553 |
| 5,035,429 | A | | 7/1991 | Redrow | |
| 5,207,423 | A | * | 5/1993 | Short | 473/553 |
| 5,310,181 | A | | 5/1994 | Chan | |
| 5,310,182 | A | | 5/1994 | Macknigg | |
| 5,393,052 | A | * | 2/1995 | Kennedy | 473/285 |
| 5,441,258 | A | | 8/1995 | Pagan | |
| 5,449,169 | A | * | 9/1995 | Hardin et al. | 473/408 |
| 5,653,441 | A | | 8/1997 | Woltanski | |
| 5,823,900 | A | | 10/1998 | Harren et al. | |
| D407,895 | S | * | 4/1999 | Staley | D3/207 |
| D417,834 | S | * | 12/1999 | Rompel | D8/348 |
| 6,210,296 | B1 | * | 4/2001 | Gabriel | 473/464 |
| D467,477 | S | * | 12/2002 | Berens et al. | D8/14 |

* cited by examiner

*Primary Examiner*—Raleigh W. Chiu
(74) *Attorney, Agent, or Firm*—John E. Wagner; Robert C. Smith

(57) ABSTRACT

A tool for realigning or straightening the strings of a racquet. The tool has a generally rectangular tip which is precisely dimensioned to fit within the normal space between the strings of a racquet. To realign the racquet strings, the tip is placed into the space defined by the strings and the strings are automatically adjusted to their preferred alignment. The string straightening tool is portable and compact, allowing the user to carry the device on his/her person and to use the device during lulls in play during the game.

12 Claims, 3 Drawing Sheets

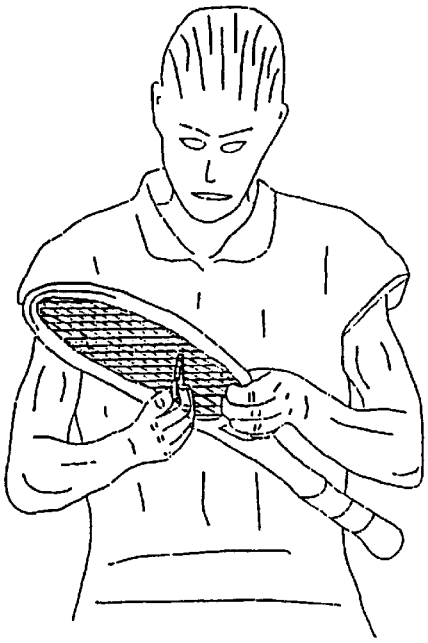
Fig. 1
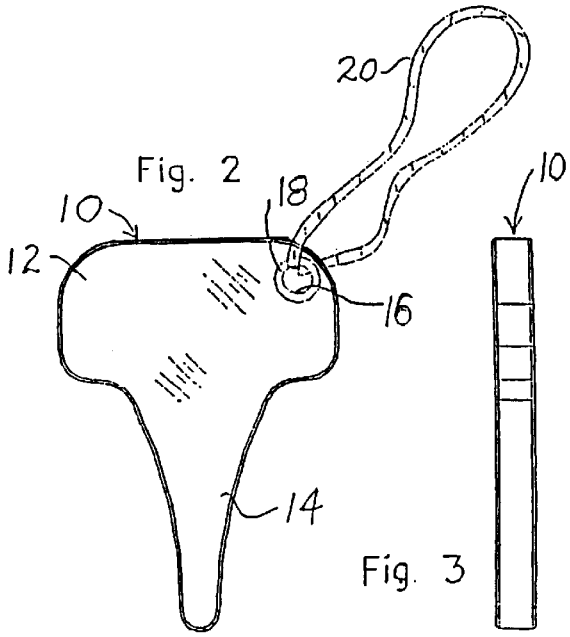
Fig. 2
Fig. 3
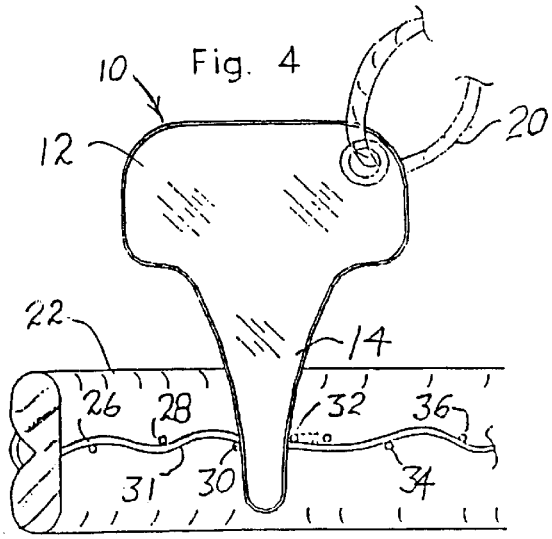
Fig. 4
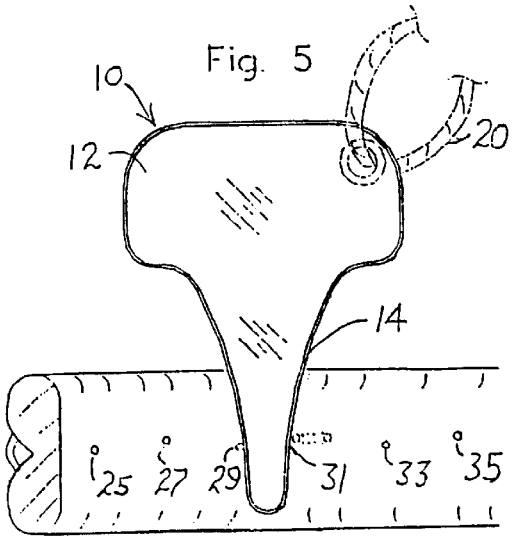
Fig. 5

RACQUET STRING ALIGNMENT TOOL

REFERENCE TO RELATED APPLICATION

This non-provisional patent application claims benefit of U.S. provisional patent application Serial No. 60/291,491 filed May 16, 2001, and hereby claims the benefit of the embodiments therein and of the filing date thereof.

BACKGROUND OF THE INVENTION

Tennis racquet strings or strings of similar racquets are subject to being moved out of alignment, particularly where the player has a powerful stroke and hits the ball hard. Upon impact, the strings impacting the ball can move out of alignment and thus the spacing between the strings becomes irregular. It is typical to see world ranked tennis players, for instance, constantly hand moving the strings of their racquets, and particularly the strings of the "sweet spot" in the central area of the racquet, back into alignment between the times when the ball is in play.

A number of patents and design patents have been issued over the years disclosing and protecting various types of racquet string aligners.

Some of the string aligners have made use of a base or platform supporting a plurality of spaced projections which are formed or sized to be inserted into the spaces between the strings to align the strings. Such arrangements are shown in U.S. Pat. No. 4,989,864 to Ubl, U.S. Pat. No. 5,823,900 to Harren et al., or U.S. Pat. No. 5,310,181 to Chan.

Other devices for aligning the strings teach a comb-like structure with the spacing of the teeth arranged such that when the teeth are inserted between the strings, any misaligned strings will be pushed back into the proper spacing. This or similar structure are shown in U.S. Pat. No. 5,035,429 to Redrow; U.S. Pat. No. 5,207,423 to Short, and U.S. Pat. No. 4,776,591 to Ho.

While all of the above devices are effective to align the strings of a racquet, none are sufficiently light and portable to be conveniently carried and used by a player during the course of play. Because a player may find that the strings of his racquet are misaligned during a match, he or she may attempt to deal with the misalignment by physically pushing the strings into a desired position with their fingers. This can be difficult and painful. Since prior art alignment devices are, for the most part, too heavy or awkward to carry during play, and perhaps banned from the court during play, there is a need for a simple, lightweight tool which can be carried and used to straighten or align tennis racquet strings during play.

BRIEF SUMMARY OF THE INVENTION

The string alignment tool or device of the present invention comprises a unitary "T"-shaped member in which the top or cross piece of the "T" is essentially a handle and the lower vertically extending tapered portion is a tool for forcing or pushing the strings of a tennis racquet into a desired alignment with other strings. The vertically extending part is smoothly tapered from the handle portion to its lower end, and all edges are smoothed such as to avoid abrading the strings. This unitary part is preferably molded of a suitable plastic material, although it could be stamped, particularly if formed of a metal, such as aluminum.

The string alignment tool is relatively small, lightweight and smooth to the touch. It is, or may be, carried in a molded holster having mating internal contours and which may be carried on a player's belt. It may also be carried in a pocket formed on a sweat-absorbing wristband where it is reasonably secure and convenient to reach and replace.

It is also convenient for players to simply carry the string alignment tool on a cord passing through the handle portion.

It will be recognized that applicants' string alignment tool does not function as do those prior art devices that force a plurality of spaced projections through the spaces between the strings; however, it will always be obvious to a player which space or spaces have become widened from impact with the ball, and the aligner is simply inserted into an adjacent space to move the displaced string as required.

BRIEF DESCRIPTION OF THE DRAWINGS

This invention may be more clearly understood with the following description and by reference to the drawings in which:

FIG. 1 is a view of a player using the string alignment tool of the present invention;

FIG. 2 is a front elevational view of the string aligner of the invention and a cord for carrying it;

FIG. 3 is a side or edge view of the aligner of FIG. 2;

FIG. 4 shows the aligner of FIGS. 2 and 3 inserted between strings of a tennis racquet shown partly in section, to move a string;

FIG. 5 is a view similar to FIG. 3 indicating movement of a tennis racquet strings as a result of insertion of the device of FIGS. 2 and 3;

DETAILED DESCRIPTION

Figure 6:
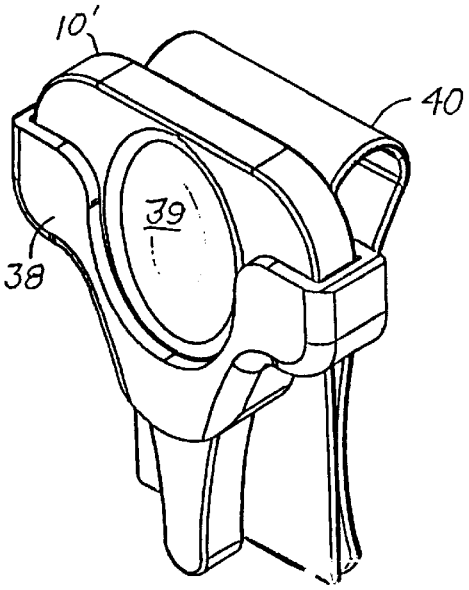
FIG. 6 is a front perspective view of the string aligner of the invention positioned in a holster therefor.

FIG. 1 is a view of a player holding a tennis racquet with his left hand and using the string alignment tool of the invention in his right hand to straighten the strings of a racquet.

Referring now to FIG. 2, the string alignment tool 10 of the invention is preferably a unitary, essentially flat "T-shaped" member formed of a molded plastic, which may be opaque of any desired color, translucent or substantially transparent. The upper handle part 12 has sufficient depth to provide good purchase for the hand of a tennis player. The vertically extending part 14 consists of a smoothly tapering tool portion having greater width at the top and tapering inwardly from both edges to a width slightly less than the desired spacing between the strings of a tennis racquet. All of the edges of the alignment tool 10 are preferably rounded to prevent cutting into the user's hands or the racquet strings. In the embodiment illustrated in FIG. 2, a port 16 is formed in the handle part 12 having a radiused or rounded edge 18.

A cord 20 is passed through the opening to serve as a means of carrying the alignment tool 10.

FIG. 3 is a side or edge view of the alignment tool 10 without cord 20. As will be seen, the opposite faces of tool 10 are preferably parallel to each other. The thickness of tool 10 should be sufficient to provide very good stiffness without inhibiting the user from inserting tool 10 between the racquet strings.

In FIG. 4, the alignment tool 10 is shown in association with a fragmentary portion of a tennis racquet 22. A single transverse string 31 is shown extending generally across the racquet and woven among a plurality of longitudinal strings 26, 28, 30, 32, 34, and 36 extending perpendicularly to string 24. In this view, it will be seen that as the aligning tool 10 is moved downwardly, it will open the space between strings 30 and 32 by moving string 32 to the right, as indicated.

While applicant is aware that the several strings referred to herein may all be parts of a single string laced through the racquet, it is convenient to refer to each string section as a separate string.

FIG. 5 shows aligning tool 10 used in essentially the same manner as shown in FIG. 4 to straighten longitudinal strings 25, 27, 29, 31, 33, and 35 of tennis racquet 22, which run perpendicularly to strings 26–36 of FIG. 4. As shown, moving tool 10 downwardly causes the tapered portion 14, as it imposes a progressively wider cross-section between the strings, to open the space between the string 29 and 31, forcing string 31 to the right. Since, as shown, string 31 is the one which was initially displaced during play, it will tend to be moved back more easily than string 29. Should string 29 tend to move also, this can be counteracted by the player by imposing a small rightwardly directed force on the tool 10.

FIG. 6 is a perspective view of the alignment tool 10' carried in a belt-supported holster 38. Tool 10' differs somewhat from tool 10 in that rather than having a small port 16 located on one side of handle part 12, tool 10' has a larger, centrally located finger grip 39. Holster 38 has an inside pocket contoured to mate with tool 10, and an opening in its lower central portion to receive and the tapered portion 14 of tool 10'. A belt loop member 40 is secured to the back side of holster 38 to be carried on a belt of a player.

Figure 7:
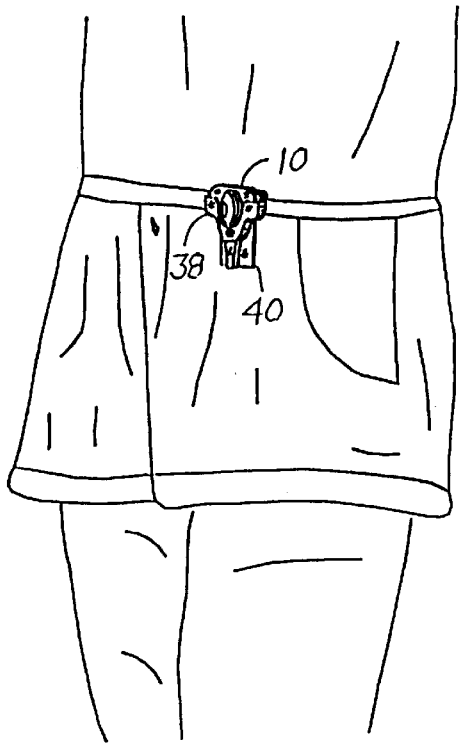
FIG. 7 is a view of the string aligner and holster of FIG. 6 carried on the belt or waistband of a player.
Figure 8:
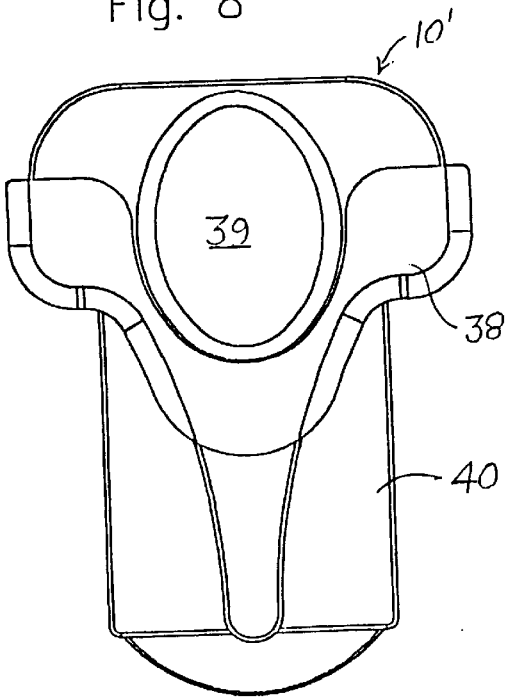
FIG. 8 is a front elevational view of the string aligner and holster of FIGS. 6 and 7.
Figure 9:
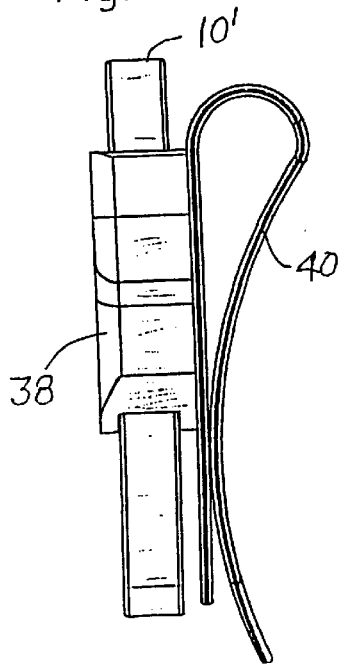
FIG. 9 is a right side view of the string aligner and holster of FIGS. 6, 7 and 8.

FIG. 7 is a partial view of a player carrying the holster 38 and alignment tool 10 or 10' on a belt or waistband;

FIGS. 8 and 9 are front elevation and side views, respectively, of tool 10' carried in holster 38, including belt loop member 40.

Figure 10:
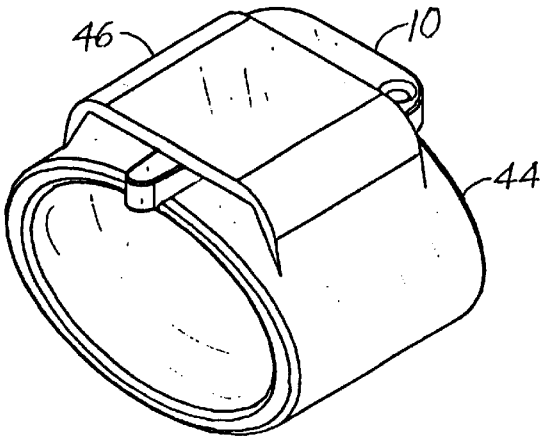
FIG. 10 is a perspective view of a wristband carrying the string aligner.

FIG. 10 is a perspective view of a wristband 44 of the type many players use to absorb perspiration developed during play. Attached to the wristband 40 is a built-in strap 46, which is sized to carry tool 10 or 10'.

Figure 11:
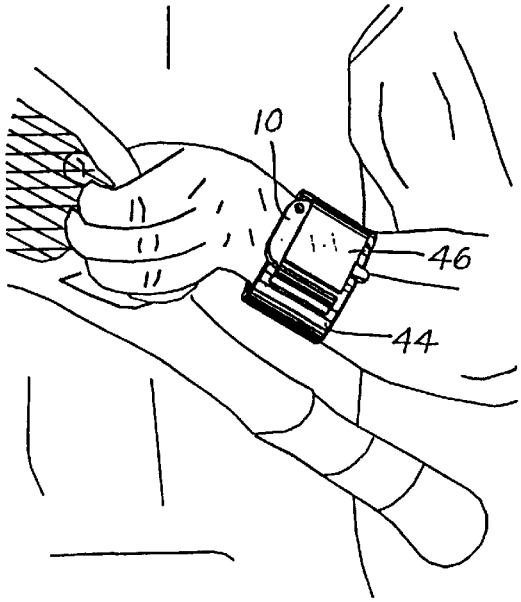
FIG. 11 is a fragmentary view of a player carrying the wristband and string aligner of FIG. 10.

FIG. 11 shows the wristband 44 with tool 10 carried on the wrist of a player.

Figure 12:
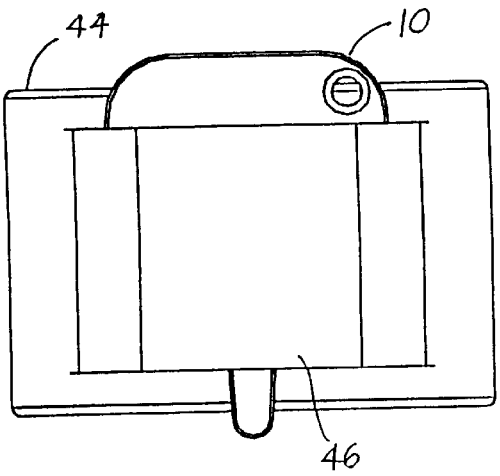
FIG. 12 is a front elevational view of the wristband and string aligner shown in FIG. 10.

FIG. 12 is a front elevational view of the wristband 44 carrying tool 10 secured behind strap 46.

Figure 13:
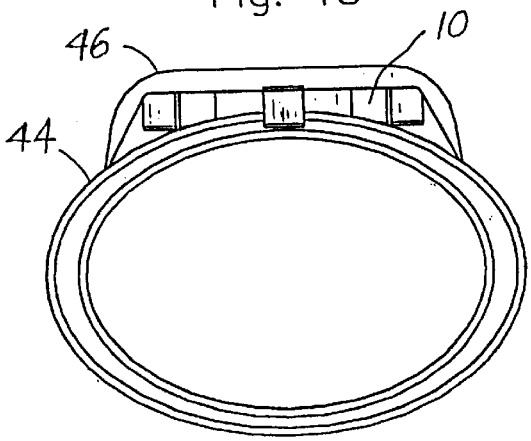
FIG. 13 is an end view of the wristband and alignment tool of FIGS. 10, 11 and 12.

FIG. 13 is an end view of wristband 44 and strap 46 carrying tool 10. It will be clear from FIGS. 10–13 that the tool 10 is carried quite securely in wristband 44 and strap 46 and yet permits easy access to tool 10 to make quick alignments of the racquet strings, even during a match.

The above-described embodiments of the present invention are merely descriptive of its principles and are not to be considered limiting. The scope of the present invention instead shall be determined from the scope of following claims, including their equivalents.

What is claimed is:

1. A tool for adjusting the strings of a racquet comprising:

a rigid, generally T-shaped, body having a grasping end constituting the head of the T and a string straightening end constituting the leg of the T;

said grasping end being generally planar and sized for ease of grasp by the user's thumb and at least one finger;

said string straightening end depending in uninterrupted tapered fashion from said grasping end and to and including a single rounded tip;

said string straightening end being generally rectangular in cross section throughout its length;

said tip dimensioned to enter the space between the strings of a racquet, such that placement of the tip within the space, and further movement of the string straightening end within the space realigns the strings defining the space to their normal straightened position;

said string straightening end having smooth edges for non-abrasion of the strings of a racquet.

2. A string-adjusting tool as recited in claim 1 wherein said body is unitary.

3. A string-adjusting tool as recited in claim 1 wherein the width of said string straightening end varies from a minimum cross section at the tip to a progressively wider cross section adjacent said grasping end to force strings to their normal spacing.

4. A string-adjusting tool as recited in claim 1 wherein the grasping end includes a centrally located recess contoured for ease of grip by a user's thumb.

5. In combination with a string-adjusting tool as recited in claim 1 further comprising:

a generally T-shaped pouch for carrying said tool;

said pouch having a front side and a back side with a single opening for receiving and holding the string-adjusting tool, said pouch further defining a recess with tapering sides corresponding to the taper of the string straightening end of said tool;

said pouch having a means for attachment to the user's clothing; and whereby said string-adjusting tool may be worn during play and used during lulls in play.

6. The combination in accordance with claim 5 wherein said means for attachment is a belt clip.

7. The combination in accordance with claim 5 wherein said opening includes a cut-out section providing access to said centrally located contoured recess.

8. A tool for adjusting the strings of a racquet comprising:

a rigid, unitary, generally T-shaped, body having a grasping end and a string straightening end;

said grasping end being generally planer and sized for ease of grasp by the user's thumb and at least one finger;

said string straightening end depending in uninterrupted tapered fashion from said grasping end to and including a single rounded tip;

said string straightening end being generally rectangular in cross section;

said tip dimensioned to enter the space between the strings of a racquet, such that placement of the tip within the space, and further movement of the string straightening end within the space progressively moves the strings defining the space to their preferred position; and said tip and said tip straightening end having smooth edges for non-abrasion of said strings.

9. A string-adjusting tool as recited in claim 8 wherein the width of said string straightening end varies from a minimum at the tip to a progressively wider cross section adjacent said grasping end to force strings to their normal spacing.

10. A string-adjusting tool as recited in claim 8 wherein the grasping end includes a centrally located recess contoured for ease of grip by a user's thumb.

11. A tool for adjusting the strings of a racquet comprising:

a rigid, unitary, generally T-shaped, body having a grasping end and a string straightening end;

said grasping end being generally planar and sized for ease of grasp by the user's thumb and at least one finger;

said string straightening end progressively tapering in width from a wider cross section at said grasping end to a smaller cross section adjacent a single rounded tip;

said string straightening end being generally rectangular in cross section;

said tip and said adjacent smaller cross section being dimensioned to enter the space between the strings of a racquet, such that advancing said string straightening end further within the space displaces the strings defining the space to their preferred position;

said string straightening end having smooth edges for non-abrasion of said strings.

12. A string-adjusting tool as recited in claim 11 wherein the grasping end includes a centrally located recess contoured for ease of grip by a user's thumb.

* * * * *

UNITED STATES PATENT AND TRADEMARK OFFICE

CERTIFICATE OF CORRECTION

PATENT NO. : 6,692,387 B2 
DATED : February 14, 2004
INVENTOR(S) : Randall S. Berens, Michael G. Sullivan and John Hunter It is certified that error appears in the above-identified patent and that said Letters Patent is hereby corrected as shown below:

Title page,
Item [76], Inventors, please add: -- John Hunter --

Signed and Sealed this

Twentieth Day of April, 2004

JON W. DUDAS
*Acting Director of the United States Patent and Trademark Office*